United States Patent [19]

Williamson

[11] Patent Number: 4,559,088

[45] Date of Patent: Dec. 17, 1985

[54] RUST PREVENTATIVES

[75] Inventor: Stanley C. Williamson, Burlington, Iowa

[73] Assignee: Amchem Products, Inc., Ambler, Pa.

[21] Appl. No.: 610,535

[22] Filed: May 15, 1984

[51] Int. Cl.[4] ..... C23F 7/08

[52] U.S. Cl. ..... 148/6.15 R; 106/14.12

[58] Field of Search ..... 148/6.15 R; 106/14.12

[56] References Cited

U.S. PATENT DOCUMENTS

| | | | |
|---|---|---|---|
| 2,080,299 | 5/1937 | Benning | 148/6.15 R |
| 2,285,855 | 2/1944 | Baxter | 148/6.15 R |
| 2,472,099 | 6/1949 | Engle | 148/6.15 R |
| 2,481,372 | 9/1949 | Fuchs | 148/6.15 R |
| 2,574,955 | 11/1931 | Bishop | 148/6.15 R |
| 2,587,340 | 2/1952 | Lewis | 148/6.15 R |
| 3,185,596 | 5/1965 | Schiffman | 148/6.16 |
| 4,183,772 | 1/1980 | Davis | 148/6.16 |
| 4,373,968 | 2/1983 | Hess | 148/6.2 |

FOREIGN PATENT DOCUMENTS

| | | | |
|---|---|---|---|
| 0039644 | 3/1975 | Japan | 148/6.15 R |

*Primary Examiner*—Sam Silverberg

*Attorney, Agent, or Firm*—Ernest G. Szoke; Henry E. Millson, Jr.; Mark A. Greenfield

[57] ABSTRACT

An aqueous rust preventative composition for application to iron-containing alloys which contains a monoalkali or monoalkanolamine salt of a phosphoric acid ester of an unsaturated hydroxy fatty acid containing from 14 to 20 carbon atoms.

9 Claims, No Drawings

RUST PREVENTATIVES

This invention relates to rust preventatives. It particularly relates to compounds exhibiting rust preventative properties and to compositions containing said compounds. It further relates to compounds and compositions which provide conveyor chain lubrication or the dual function of a rust preventative and conveyor chain lubricant.

BACKGROUND OF THE INVENTION

The use of rust preventatives in coatings for iron containing alloys such as, for example, various types of steels is well known. Many of these compositions contain phosphoric acid and/or salts thereof. It is also common to include in such compositions resins such as polyacrylates to provide a substantive coating. While these compositions are useful in preventing or reducing the rusting in steels (as described in U.S. Pat. Nos. 3,185,596; 4,183,772 and 4,373,968), the use of these compositions is not free from such problems as instability of the preparations and difficulty in obtaining uniform coatings. Furthermore, these compositions, although useful rust inhibiting precoats before the application of siccative coatings, have poor lubricant properties.

It is, accordingly, an object of this invention to provide rust preventative compounds which are water-soluble and which can be applied in aqueous compositions.

It is a further object of this invention to provide rust preventative compounds which will react with the steel substrate on drydown after the application thereto.

It is another object of this invention to provide rust preventative compositions which form rust preventative films on the steel substrate which on drying are non-oily and non-irritating and which are acceptable in the food processing industry for incidental contact with foods.

It is still another object of this invention to provide rust preventative compositions which can be applied on wet surfaces of steel and which exhibit little or only moderate foaming during application.

It is still another object to provide a film which is rust preventative, is water repellant, and which exhibits lubricating properties.

Other objects will appear in the description which follows:

DESCRIPTION OF THE INVENTION

In accordance with this invention it has been found that a phosphoric acid ester of an unsaturated hydroxy fatty acid is an excellent rust preventative when applied to steels in the form of its mono-alkali metal salt or mono-alkanolamine salt in an aqueous solution having a pH of from about 7 to about 8.

Suitable unsaturated hydroxy fatty acids contain from 14 to 20 carbon atoms and are preferably mono-unsaturated. The preferred unsaturated hydroxy fatty acid is ricinoleic acid.

The phosphoric acid ester is readily prepared by mixing the unsaturated hydroxy fatty acid with a stoichiometric amount of 115% polyphosphoric acid (available from Food Machinery and Chemical Corp.). The reaction is rapid and mildly exothermic and does not require any application of external heat. After the reaction is completed, a base such as an alkali hydroxide, e.g. sodium or potassium hydroxide, or an alkanolamine, e.g. trialkanolamines, e.g. triethanolamine, or a mono-alkanolamine, e.g. aminoethylpropanol, is added in an amount just sufficient to form the monobasic salt of the phosphoric acid ester of the unsaturated hydroxy fatty acid and the monobasic salt of the phosphoric acid by-product of the esterification. Ammonia is added to bring the pH in the range of about 7 to about 8, preferably between about 7.5 and about 7.9. If desired, isopropanol can be added to serve as a coupling solvent for coating leveling or solution clarity. The concentration of the isopropanol in the concentrate described below ranges from 0 to about 10% by weight. The product is diluted with water to form an aqueous concentrate containing from about 25 to about 35% by weight of the monobasic salt of the phosphoric acid ester of the unsaturated hydroxy carboxylic acid, the monobasic salt of the by-product phosphoric acid, and ammonia. This concentrate is then diluted with water to from about 5 to about 10% by volume prior to use.

The diluted solution can be applied to the metallic surface by spraying, flow-on, brushing or immersion. The metallic surface is cleaned prior to the application but need not be dry.

In the practice of this invention it has been found that a relatively pure unsaturated hydroxy fatty acid need not be used. It may contain other carboxylic acids which are unreactive to the polyphosphoric acid and still be suitable. In the actual practice of the invention the preferred acid, ricinoleic acid, is used as a castor oil fatty acid concentrate (P-10 acids from Caschem) containing about 89.5% by weight of the ricinoleic acid with the remaining 10.5% a blend of carboxylic acids having an average molecular weight of about 282 and not containing any group reactive to the polyphosphoric acid. When this mixture is used it is also necessary to neutralize these excess unreactive acids, so additional base is added.

The invention will become clearer from the samples which follow. These examples are given by way of illustration and are not to be considered as limiting.

EXAMPLE 1

Preparation of the Phosphoric Acid Ester of Ricinoleic Acid 100 g of P-10 acids (Caschem) containing 89.5 g of ricinoleic acid (0.30 mole) was mixed with stirring with 36.66 g (0.30 mole) of 115% polyphosphoric acid and the reaction, which was mildly exothermic, allowed to proceed at room temperature. The resulting premix product contained about 10.5 g of unreacted carboxylic acids from the P-10 acids, about 12.5 g of phosphoric acid by-product, and about 113 g of the phosphoric acid ester of ricinoleic acid.

EXAMPLE 2

Following the procedure of EXAMPLE 1, 100 g of the phosphoric acid ester of ricinoleic acid as a premix product was prepared using 73.2 g of the P-10 acids and 26.8 g of the 115% polyphosphoric acid. The ester content of this premix is about 83% by weight or about 83 g.

EXAMPLES 3 to 6 illustrate concentrate compositions. In preparing these concentrates, a desired amount of the premix product, prepared as described in EXAMPLE 1 and 2, was dissolved in a small amount of water and a selected base was added in an amount just sufficient to form the monobasic salts of the phosphoric acid ester of ricinoleic acid, the by-product phosphoric acid, and the unreacted fatty acids. The examples indicate the base which was used and the amount needed to effect the desired formation of the salts. Ammonia was added, either in concentrated aqueous solution or as a gas, to bring the pH between 7.5 and 7.8. Isopropanol was added in the quantities shown, so that its concentration in the concentrate was between 0 and about 100% by weight. Water was then added to bring the materials in the concentrate to the desired concentrations. In these examples concentrations are given in percent by weight unless otherwise indicated.

EXAMPLE 3

| | |
|---|---|
| Phosphoric acid ester of ricinoleic acid - premix of EXAMPLE 2 | 20.0 |
| Triethanolamine | 10.2 |
| Ammonia (aqu. 29.4%) | 3.5 |
| Water q.s. | 100.0 |

EXAMPLE 4

| | |
|---|---|
| Phosphoric acid ester of ricinoleic acid - premix of EXAMPLE 2 | 20.0 |
| Isopropanol | 5.0 |
| Aminomethyl-propanol | 6.4 |
| Ammonia (aqu. 29.4%) | 3.5 |
| Water q.s. | 100.0 |

EXAMPLE 5

| | |
|---|---|
| Phosphoric acid ester of ricinoleic acid - premix of EXAMPLE 2 | 20.0 |
| Isopropanol | 10.0 |
| Liquid caustic potash (45% aqu.) | 8.6 |
| Ammonia (aqu. 29.4%) | 3.5 |
| Water q.s. | 100.0 |

EXAMPLE 6

| | |
|---|---|
| Phosphoric acid ester of ricinoleic acid - premix of EXAMPLE 2 | 20.0 |
| Isopropanol | 10.0 |
| Liquid caustic soda (50% aqu.) | 5.5 |
| Ammonia (aqu. 29.4%) | 3.5 |
| Water q.s. | 100.0 |

The concentrates, thus prepared, were stable on standing under varying ranges of temperatures. They remained clear and no sludge formation occurred. Since the pH of these concentrates was in the range of 7.5 to 7.9 they required no special handling.

For optimum rust prevention an aqueous solution containing about 5 to about 10% by volume of the concentrate was applied by spraying, flow-on, brushing or immersion on a clean surface of the steel or other iron-containing alloy. It was not necessary that the surface be dried prior to application. Little or only moderate foaming occurred during the application.

The film which formed on drying was resistant to water and effectively protected the steel against rusting. If it should become necessary to remove the film, this can readily be done by treatment with concentrated aqueous potash or soda which dissolves the film.

When applied to movable parts such as bearings and the like, the film also functions as a lubricant. If however, it is only desired to use the film for its lubricant effect, the amount of concentrate in the solution being applied can be reduced to less than 5% by volume, even as low as 1%.

What is claimed is:

1. A process for inhibiting the formation of rust which comprises applying to an alloy containing iron a rust inhibiting quantity of a rust preventative compound selected from the mono-alkali and monoalkanolamine salts of phosphoric acid esters of unsaturated hydroxy fatty acids containing from 14 to 20 carbon atoms.

2. A process in accordance with claim 1 wherein an aqueous solution of the rust preventative compound is applied to the alloy and the solution dried or allowed to dry on the alloy to form a protective film thereon.

3. A process in accordance with claim 1 wherein the unsaturated hydroxy fatty acid component of the rust preventative compound is mono-unsaturated.

4. A process in accordance with claim 3 wherein said unsaturated hydroxy fatty acid component is from ricinoleic acid.

5. A process in accordance with claim 1 wherein the rust preventative compound is in the form of a sodium or potassium salt.

6. A process in accordance with claim 1 wherein the rust preventative compound is in the form of a trialkanolamine salt.

7. A process in accordance with claim 6 wherein the trialkanolamine salt is the triethanolamine salt.

8. A process in accordance with claim 1 wherein the rust preventative compound is in the form of a monoalkanolamine salt.

9. A process in accordance with claim 8 wherein the monoalkanolamine salt is the aminomethylpropanol salt.

* * * * *